US010727623B2

(12) United States Patent
Beck et al.

(10) Patent No.: US 10,727,623 B2
(45) Date of Patent: Jul. 28, 2020

(54) ELECTRICAL CONNECTING UNIT AND SEALING ARRANGEMENT FOR AN ELECTRICAL CONNECTOR AND METHOD FOR ITS PRODUCTION

(71) Applicant: TE Connectivity Germany GmbH, Bensheim (DE)

(72) Inventors: Karl Beck, Langen (DE); Rudi Blumenschein, Ellwangen (DE); Heinrich Romuald Schmidt, Langen (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/144,228

(22) Filed: Sep. 27, 2018

(65) Prior Publication Data

US 2019/0097349 A1 Mar. 28, 2019

(30) Foreign Application Priority Data

Sep. 28, 2017 (DE) ..... 10 2017 122 591

(51) Int. Cl.

| | |
|---|---|
| ***H01R 13/52*** | (2006.01) |
| ***H01R 43/00*** | (2006.01) |
| *H01R 43/20* | (2006.01) |
| *H01R 13/41* | (2006.01) |

(52) U.S. Cl.

CPC ..... *H01R 13/521* (2013.01); *H01R 13/5205* (2013.01); *H01R 13/5216* (2013.01); *H01R 43/005* (2013.01); *H01R 13/41* (2013.01); *H01R 43/20* (2013.01)

(58) Field of Classification Search

CPC ..... H01R 13/521; H01R 13/5205; H01R 13/5216; H01R 43/005; H01R 13/41; H01R 43/20

USPC ..... 439/275, 276, 586–588, 936, 272, 273

See application file for complete search history.

(56) References Cited

U.S. PATENT DOCUMENTS

| | | | | |
|---|---|---|---|---|
| 6,059,594 A * | 5/2000 | Davis | H01R 13/5205 | 439/275 |
| 6,142,825 A * | 11/2000 | Shinchi | H01R 13/5216 | 439/587 |
| 7,037,146 B2 * | 5/2006 | Nakamura | H01R 12/585 | 439/751 |
| 7,070,449 B2 * | 7/2006 | Miyazaki | H01R 9/032 | 439/272 |

(Continued)

FOREIGN PATENT DOCUMENTS

| | | |
|---|---|---|
| JP | 2013-187041 A | 9/2013 |
| WO | 2015104992 A1 | 7/2015 |
| WO | 2017154543 A1 | 9/2017 |

OTHER PUBLICATIONS

Search Report, dated Jul. 31, 2017, 4 pages.

(Continued)

*Primary Examiner* — Travis S Chambers

(74) *Attorney, Agent, or Firm* — Barley Snyder

(57) ABSTRACT

An electrical connecting unit for an electrical connector comprises an adhesive disposed at least partially circumferentially around the electrical connecting unit or at at least a side of the electrical connecting unit. The adhesive is elastically and/or plastically deformable and adheres to the electrical connecting unit to provide a seal for the electrical connector.

19 Claims, 4 Drawing Sheets

(56) References Cited

U.S. PATENT DOCUMENTS

| | | | | |
|---|---|---|---|---|
| 7,708,605 | B2 * | 5/2010 | Shibata | H01R 13/41 439/733.1 |
| 2009/0035999 | A1 * | 2/2009 | Takahashi | H01R 13/41 439/751 |
| 2009/0258521 | A1 | 10/2009 | Ooki | |
| 2010/0255722 | A1 * | 10/2010 | Sander | H01R 13/521 439/587 |
| 2013/0313753 | A1 * | 11/2013 | Scheel | B29C 45/14549 264/272.14 |
| 2014/0059853 | A1 * | 3/2014 | Steinberg | H01R 43/005 29/855 |
| 2014/0242852 | A1 | 8/2014 | Matsui | |
| 2015/0180158 | A1 * | 6/2015 | Arai | H01R 13/5216 439/588 |
| 2017/0187140 | A1 | 6/2017 | Tsai et al. | |

OTHER PUBLICATIONS

German Office Action, dated May 15, 2018, 12 pages.
Extended European Search Report, Application No. 18196623.5, dated Jan. 24, 2019, 14 pages.

* cited by examiner

ELECTRICAL CONNECTING UNIT AND SEALING ARRANGEMENT FOR AN ELECTRICAL CONNECTOR AND METHOD FOR ITS PRODUCTION

CROSS-REFERENCE TO RELATED APPLICATION

This application claims the benefit of the filing date under 35 U.S.C. § 119(a)-(d) of German Patent Application No. 102017122591.9, filed on Sep. 28, 2017.

FIELD OF THE INVENTION

The present invention relates to an electrical connector and, more particularly, to sealing of an electrical connecting unit in an electrical connector.

BACKGROUND

A large number of electrical connectors and counter-connectors are known that transmit electrical currents, voltages, signals and/or data with a large range of currents, voltages, frequencies and/or data rates. In the low, medium, or high voltage and/or current ranges, and especially in the motor vehicle industry, connectors must ensure permanently, repeatedly and/or, after a comparatively long service life, transmission of electrical power, signals and/or data without delay in warm, possibly hot, polluted, humid and/or chemically aggressive environments. Due to a wide range of applications, a large number of specially configured connectors are known.

Connectors or their housings can be installed at an electrical cable, a wire, a cable harness, or an electrical unit or device such as at/in a housing, at/on a leadframe, at/on a printed circuit board etc., of an electrical, electro-optical, or electronic component. A connector located at a cable, a wire, or a cable harness is known as a connector or a plug. A connector located at an electrical component is known as a counter-connector unit, often referred to as a receptacle or header.

Connectors must ensure perfect transmission of electrical signals and/or electrical power, wherein connectors corresponding with one another usually have fastening or locking arrangements for long-term but usually releasable fastening or locking of the connector at/in the counter-connector. Further, an electrical connecting unit having a contact device, such as a contact element, a ferrule, a terminal, or a shield contact sleeve, or a contact unit, must be received securely therein. In an assembled cable, such a connecting unit can be provided as a connector without a housing. Since the housings of the connectors are usually subject to a certain standardization, such as the FAKRA standard, the most important dimensions of the housings have the same dimensions across different manufacturers. Continuous efforts are being made to improve electrical contact devices, contact units, connecting units, connectors and assembled cables to make them smaller and more cost-effective.

In the prior art, electronic and electrical components for printed circuit boards, such as headers or peg strips, are cast with a sealing material for sealing. Methods for this, such as a potting, are complex and thus costly.

SUMMARY

An electrical connecting unit for an electrical connector comprises an adhesive disposed at least partially circumferentially around the electrical connecting unit or at at least a side of the electrical connecting unit. The adhesive is elastically and/or plastically deformable and adheres to the electrical connecting unit to provide a seal for the electrical connector.

BRIEF DESCRIPTION OF THE DRAWINGS

The invention will now be described by way of example with reference to the accompanying Figures, of which.

DETAILED DESCRIPTION OF THE EMBODIMENTS

Figure 1:
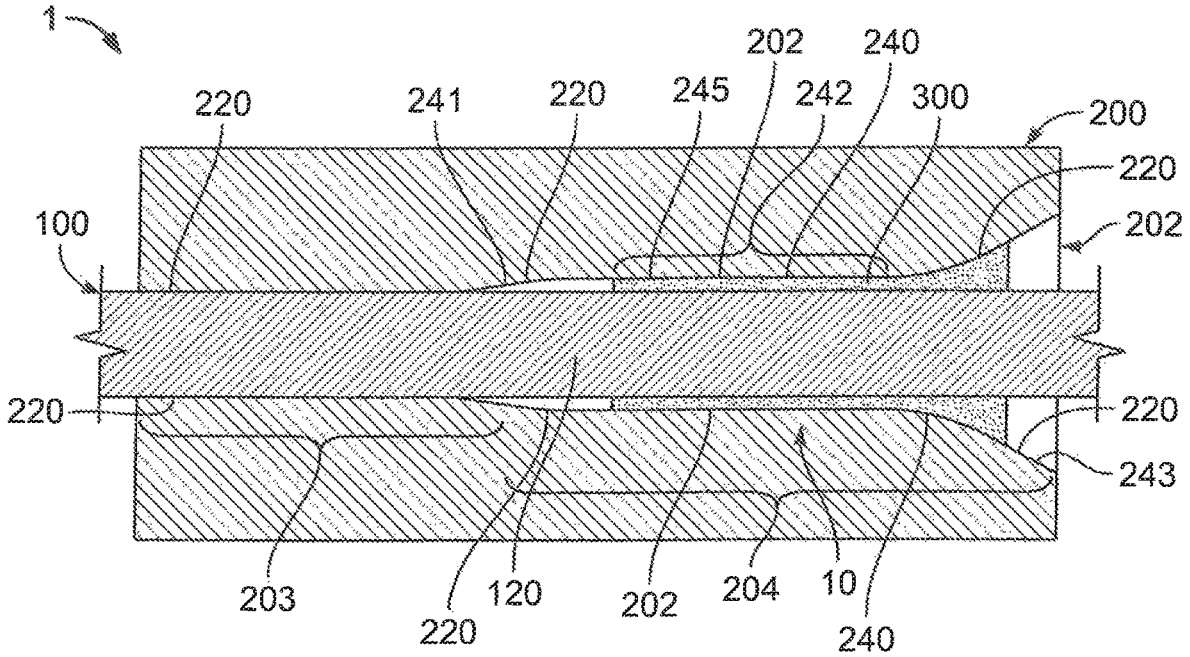
FIG. 1 is a sectional side view of an electrical connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

An electrical connecting unit 100 and a sealing arrangement 10 for an electrical connector 1 are described herein with reference to FIGS. 1-9. In an embodiment, the electrical connector 1 is for a printed circuit board 0, and may be referred to as a printed circuit board connector 1, and/or a unit 0 in the automotive industry. The description herein can be applied to other types of connectors 1, other types of connecting units 100 such as terminals, contact units, or contact devices, or also to cables within the automotive industry or outside the automotive industry such as in electronics, electrical engineering, or power engineering.

The connector 1 can be formed, for example, as a pin, peg, tab, socket, hybrid connector, flying coupling, built-in plug, built-in socket, plug receptacle, socket receptacle, header, interface, or any other type of connector 1. Furthermore, the terms connector and mating connector, connecting unit and mating connecting unit, pin-/peg-/tab contact device/-unit and socket contact device/-unit are intended to be synonymous and optionally interchangeable with one another.

The description of the embodiments with reference to the drawings is subsequently related to an axial or longitudinal direction Ax (longitudinal axis Ax), a transverse direction Qr (transverse axis Qr), a vertical direction Hr (vertical axis Hr), a radial direction Ra and a circumferential direction Um of the connector 1, the sealing arrangement 10, the connecting unit 100, and a connector receptacle 200.

In principle, it is important to seal an electrical connector 1, such as a printed circuit board connector 1, from a plug face side relative to a substrate 0, such as a printed circuit board, a device, a unit, a cable, or a cable harness, against an ingress of a moisture into and as a result through the connector 1. The description of the embodiments herein, as described in greater detail below, relates to the sealing arrangement 10 for the connector 1 with an adhesive 300 which is coated or injected onto an electrical connecting unit 100 of the connector 1. The adhesive 300 is formed as a sealant 300 or a sealing glue 300. A sealing function of the adhesive 300, in an embodiment, is substantially based on a compression of the adhesive 300.

A first embodiment of an electrical connector 1 is shown in FIGS. 1-4. An electrical connecting unit 100 of the electrical connector 1 is formed as a tab contact unit 100 which can be mechanically connected to a printed circuit board 0 and electrically connected to an electrical conductor track of the printed circuit board 0.

Figure 2:
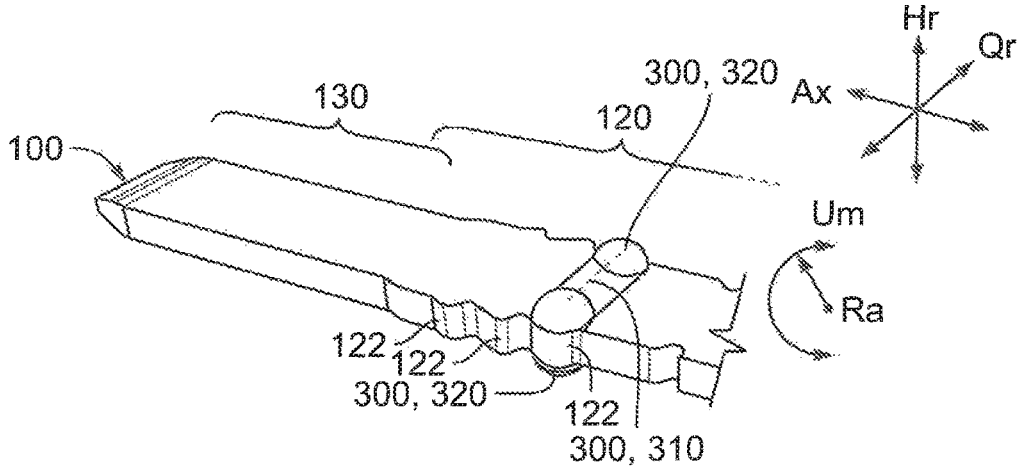
FIG. 2 is a perspective view of an electrical connecting unit of the electrical connector of FIG. 1.
Figure 5:
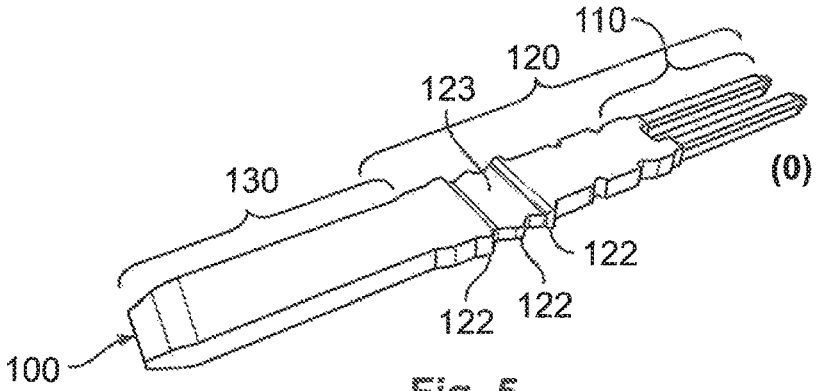
FIG. 5 is a perspective view of an electrical connecting unit according to another embodiment.

The connecting unit 100, as shown in FIG. 2, is divided into a mechanical assembly section 120, the free longitudinal end section thereof forming an electromechanical terminal section 110 of the connecting unit 100 as shown in FIG. 5. In the axial direction Ax opposite the terminal section 110, the connecting unit 100 has, directly connected to the assembly section 120, an electromechanical contact section 130. In the embodiment shown in FIG. 2, the electromechanical contact section 130 is formed as a tab contact section 130. In an embodiment, the entire connecting unit 100 is formed integrally. In an embodiment, the connecting unit 100 can be formed by a stamping method, an embossing method, a crimping method, a bending method and/or a joining method, etc.

With the exception of the terminal section 110, as shown in FIG. 2, the cross-sections of the connecting unit 100 are formed substantially rectangular. The assembly section 120 has, at both its small-area side surfaces, extending in the axial direction Ax and vertical direction Hr, at least one latching unit 122. The latching unit 122 may be in the form of a latching projection 122, a latching shoulder 122 or a latching recess. The connecting unit 100 can be locked in place or can be latched at/in a connector receptacle 200 by the latching units 122. In other embodiments, the connecting unit 100 may alternatively be a socket and/or peg connecting unit.

Figure 3:
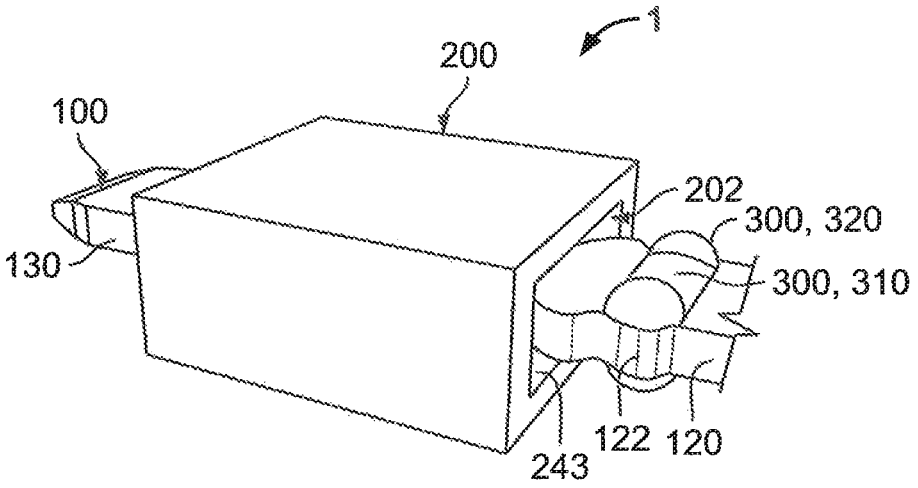
FIG. 3 is a perspective view of the electrical connecting unit with a seal before insertion of the seal into a connector receptacle of the electrical connector of FIG. 1.
Figure 4:
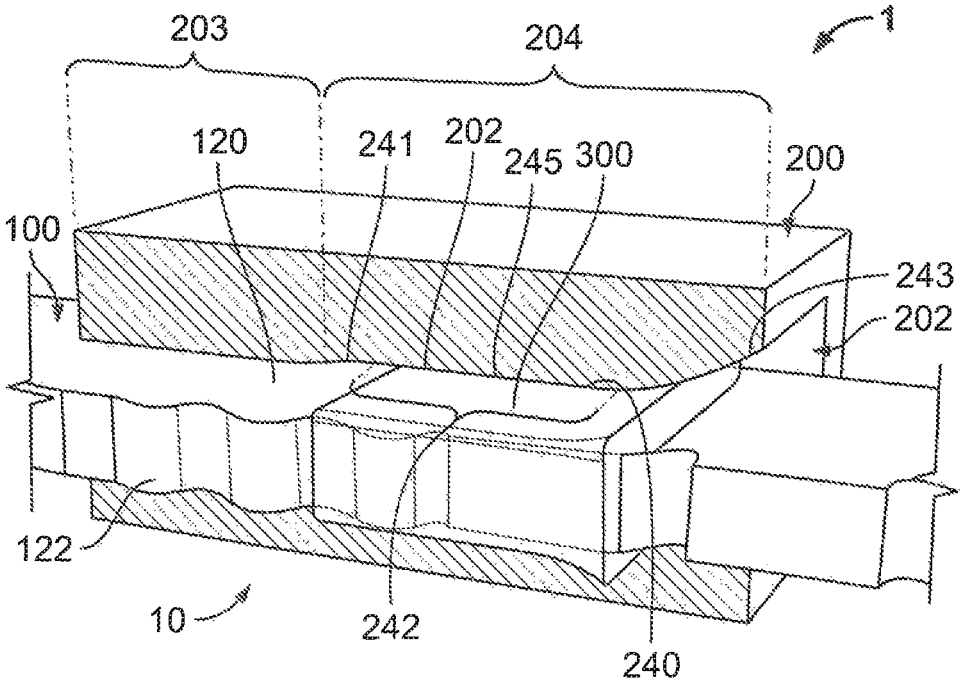
FIG. 4 is a sectional perspective view of the electrical connecting unit with the seal after insertion of the seal into the connector receptacle of FIG. 1.

The connector receptacle 200, as shown in FIGS. 1, 3, and 4, is formed as a housing 200 for a peg strip. The connector receptacle 200 can of course be formed as almost any other housing for an electrical connecting unit 100. In an embodiment, the connector receptacle 200 is integrally formed in a single piece. The connector receptacle 200 has, for every connecting unit 100, an assembly chamber 202 which extends completely through the connector receptacle 200 and which has a centering section 203 and a sealing section 204 as shown in FIGS. 1 and 4. The assembly chamber 202 at the centering section 203 and the sealing section 204 is delimited by an inner wall 220 on the inside of the connector receptacle 200. The assembly chamber 202 can be formed as a cylindrical recess or a cuboid recess. The connector receptacle 200 is formed of an insulative material.

In the centering section 203, the connecting unit 100 can be centered inside the connector receptacle 200 and as a result obtains its end position at/in the connector receptacle 200 in the vertical direction Hr and transverse direction Qr. Starting from the centering section 203, the assembly chamber 202 undergoes an expansion 245 in its sealing section 204 in at least one vertical direction Hr and optionally in at least one transverse direction Qr, as shown in FIG. 1. With the exception of one or a plurality of latching units in the assembly chamber 202, an inner dimension of the sealing section 204, in an embodiment, remains substantially the same in the transverse direction Qr relative to the centering section 203.

In the vertical direction Hr opposite or at a comparatively large side surface, extending in the axial direction Ax and transverse direction Qr, of a connecting unit 100 assembled in the assembly chamber 202, the expansion 245 of the sealing section 204, starting from an axial Ax outer end of the assembly chamber 202 at a right end in FIG. 1, initially comprises an insertion region 243 of the sealing section 204 with a bevel for inserting the connecting unit 100 with a seal 300 into the assembly chamber 202. A sealing region 242 of the sealing section 204 has, with the exception of optionally one or a plurality of latching units in the sealing section 204, substantially constant inner dimensions adjoining its inner wall 240. At the sealing region 242, a bevelled region 241 of the sealing section 204 with a taper in turn adjoins the inner dimensions of the centering section 203.

In the vertical direction Hr, at least two such expansions 245 are provided opposite to or at the two comparatively large side surfaces of the connecting unit 100 assembled in the assembly chamber 202. These two expansions 245 can here also be considered as a single expansion of the assembly chamber 202. The concept of a single expansion can additionally similarly be applied to the comparatively small side surfaces of the connecting unit 100 assembled in the assembly chamber 202.

The connecting unit 100 has an adhesive 300 as the seal 300 in the related assembly section 120. The adhesive 300 can be formed as a sealant 300 or a sealing glue 300. Before assembly of the connecting unit 100, the adhesive 300 is provided at/in the connector receptacle 200 at least in sections in the transverse direction Qr or at least partially circumferential Um at the assembly section 120. The adhesive 300 is applied and hardened on the connecting unit 100, partially or fully cross-linked, and/or partially or fully solidified before assembly of the connecting unit 100 with the connector receptacle 200. The adhesive 300 is provided as a liquid material at the connecting unit 100 and then independently transitions into a solid but in an elastically to plastically deformable state. The adhesive 300 can be a chemically or physically reactive adhesive. A non-reactive adhesive can optionally also be used. The cross-linking or solidifying of the adhesive 300 can optionally also take place or be completed in the connector receptacle 200.

The adhesive 300 is provided in an extending manner at least on one side of a large side surface of the connecting unit 100, as shown in FIGS. 2 and 3, substantially in the transverse direction Qr across, in an embodiment, an entire transverse extent Qr of the connecting unit 100. The adhesive 300 is formed at least as a bulb seal 310 or an adhesive bulb 310 in a non-assembled state of the connecting unit 100; temporally before its mechanical elastic and/or plastic deformation.

The adhesive 300, as shown in FIGS. 2 and 3, can have a sealing cap 320 or an adhesive cap 320 at at least one transverse end Qr of the bulb seal 310 or the adhesive bulb 310. In an embodiment, two such sealing caps 320 or adhesive caps 320 are provided at both transverse ends Qr. The adhesive 300 is provided in this manner on both large side surfaces of the connecting unit 100. Furthermore, the adhesive 300 can be provided at one or both small side surfaces of the connecting unit 100. In a round cross-section of a connecting unit, the adhesive 300 is provided in a circumferential manner at least partially circumferential Um or fully circumferential Um at the connecting unit 100. In such an embodiment, the adhesive 300 is formed as a ring seal or an O-ring seal. The adhesive 300 can be provided as a highest point, at least on one side, of the assembly section 120. In an embodiment, the adhesive 300 can be provided in a region of the latching unit 122 but can leave the latching unit 122 open.

After the provision of the adhesive 300 at the connecting unit 100, the connecting unit 100 can be assembled at/in the connector receptacle 200. In an embodiment, the connecting unit 100 is plugged through the assembly chamber 202 of the connector receptacle 200. In another embodiment, the connector receptacle 200 and/or the connecting unit 100 may only be plugged into the connector receptacle 200 and not plugged through.

A free end of the contact section 130 of the connecting unit 100 is first plugged from the outside into the insertion region 243 of the sealing section 204 of the assembly chamber 202 and subsequently the connecting unit 100 is plugged through the assembly chamber 202 in sections. The free end of the contact section 130 is firstly centered in the insertion region 243 and finally in the bevelled region 241 of the sealing section 204. The connecting unit 100 is thus plugged through the assembly chamber 202 or plugged into it so far that the at least one latching unit 122 of the assembly section 120 of the connecting unit 100 latches with at least one corresponding latching unit of the assembly chamber 202. In this case, the related latching units 122 are formed partially complementary to one another.

When plugging in and/or at least partially plugging the connecting unit 100 into/through the assembly chamber 202, the adhesive 300 is also moved into the assembly chamber 202 as a seal 300. A dimension in the vertical direction Hr of the insertion region 243 of the assembly chamber 202 on the outside of the connector receptacle 200 is greater than a corresponding outer diameter of the connecting unit 100 together with the unstressed seal 300, as shown in FIG. 3, so that the seal 300 can be received substantially completely in the assembly chamber 202. As a result, the connecting unit 100 with seal 300 may be moved comfortably into the assembly chamber 202 and moved forward in the assembly chamber 202.

Inside the insertion region 243, an outer surface of the seal 300 mechanically contacts an inner surface or inner wall 240 of the assembly chamber 202 or the insertion region 243. Because the assembly chamber 202 is further reduced in size in this region, the seal 300 is successively increasingly mechanically compressed when moving the connecting unit 100 forward. As an available location inside the assembly chamber 202 or the expansion 245 is delimited, the seal 300 begins to lengthen or elongate. This is intended to be understood in a broad sense, wherein the seal 300 can be or is passively deformed in all spatial directions Ax, Hr, Qr, if the assembly chamber 202 and the connecting unit 100 allow, by virtue of a relative movement between the connecting unit 100 and the inner wall 240 of the sealing section 204.

This elastic and/or plastic deformation takes place substantially in the axial direction Ax of the connecting unit 100. Furthermore, in particular if initially no adhesive 300 or no seal 300 is provided at a small-area side surface of the connecting unit 100, the adhesive 300 or the seal 300 is deformed or flows into a space between a small-area outer side surface of the connecting unit 100 and the inner wall 240 of the sealing section 204, as shown in FIG. 4. In this case, an appropriate space, such as a section of the expansion 245, can be formed to be extra large such that the adhesive 300 or the seal 300 can be easily integrated therein.

According to the above description with reference to FIGS. 1-4, a single or a plurality of seals 300 of the connecting unit 100 can substantially completely or completely surround and seal the expansion 245 in a compressed manner between the connecting unit 100 and the inner wall 240 of the sealing section 204. In particular, as a result of this, a cavity at a latching unit 122 can be closed as shown in FIG. 4.

An electrical connector 1 according to another embodiment is shown in FIGS. 5-9. The electrical connecting unit 100 and the connector receptacle 200 of the connector 1 are formed similarly to the electrical connector 1 described with reference to FIG. 1-4, with the exception of the subsequently explained deviations.

Figure 6:
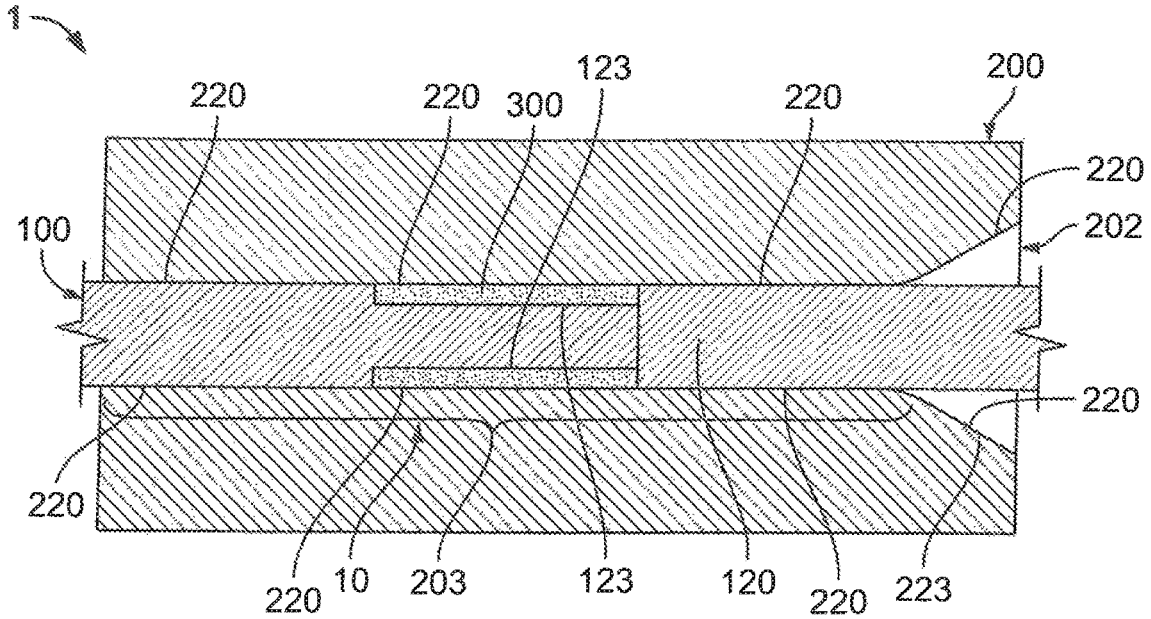
FIG. 6 is a sectional side view of an electrical connector according to another embodiment.

Deviating from the embodiment described with reference to FIGS. 1-4, in the embodiment described with reference to FIGS. 5-9, instead of the assembly chamber 202, the connecting unit 100 has the cavity formed as a seal recess 123. The seal recess 123 is formed in the connecting unit 100 as at least one seal groove 123, which is at least partially circumferential or provided on at least one side as shown in FIGS. 5 and 6. The seal groove 123 is completely circumferential at/in the connecting unit 100, with the exception of at least one latching unit 122. In this embodiment, the assembly chamber 202 is substantially completely formed as a centering section 202 as shown in FIG. 6. For an easier insertion of the connecting unit 100, the assembly chamber 202 has an insertion region 223 which is similar to the above exemplary embodiment.

Figure 7:
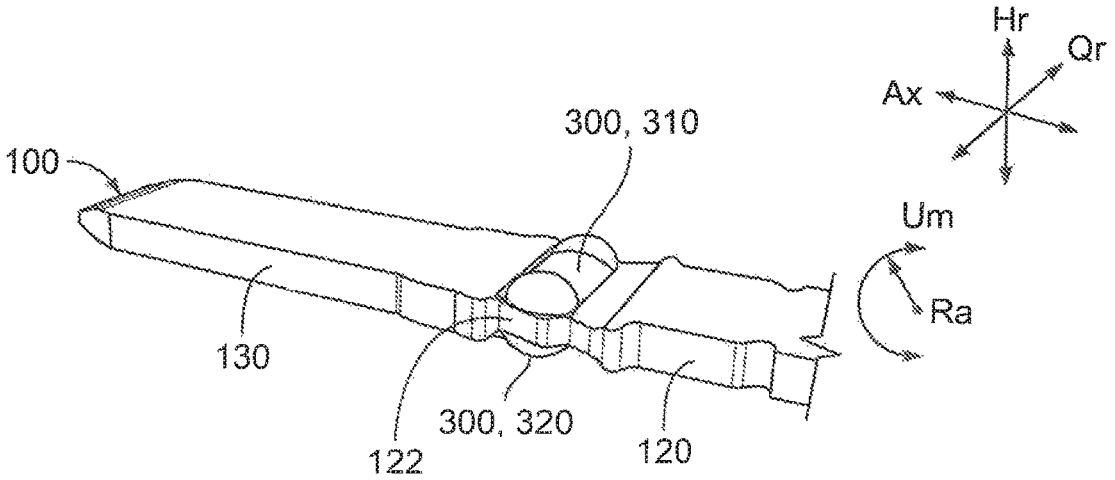
FIG. 7 is a perspective view of the electrical connecting unit of FIG. 5 with a seal.
Figure 8:
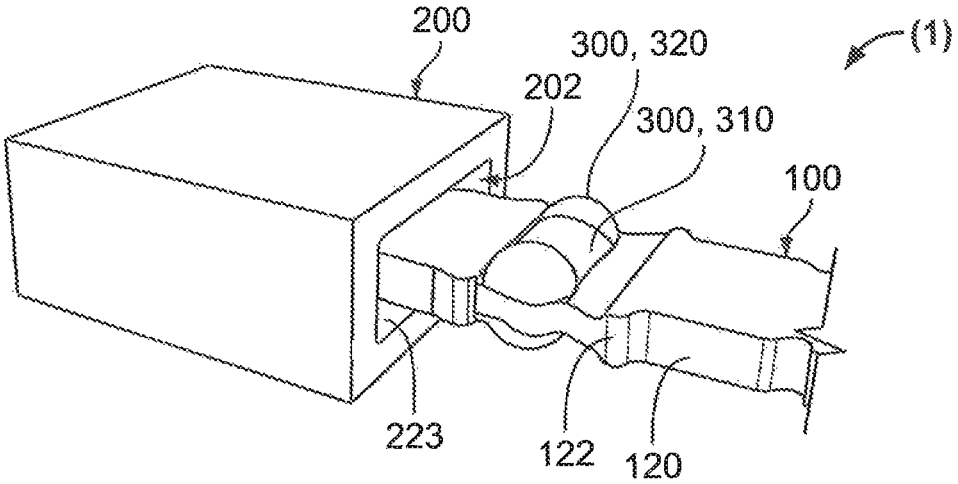
FIG. 8 is a perspective view of the electrical connecting unit with the seal before insertion of the seal into a connector receptacle of the electrical connector of FIG. 6.

The adhesive 300, as shown in FIGS. 7 and 8, is positioned in the seal recess 123 and, in an embodiment, extends substantially across an entire transverse extent of the seal recess 123 and/or substantially across an entire vertical extent of the seal recess 123. In an embodiment in which the seal groove 123 extends completely circumferentially around the connecting unit 100, the adhesive 200 also extends completely circumferentially around the connecting unit 110.

When plugging in and/or at least partially plugging the connecting unit 100 into/through the assembly chamber 202, the adhesive 300 is also in turn moved into the assembly chamber 202 as a seal 300. A dimension in the vertical direction Hr of the insertion region 223 of the assembly chamber 202 on the outside of the connector receptacle 200 is greater than a corresponding outer diameter of the connecting unit 100 together with the unstressed seal 300, so that the seal 300 can be received substantially completely in the seal groove 123.

Inside the insertion region 223, an outer surface of the seal 300 mechanically contacts an inner surface or inner wall 240 of the assembly chamber 202 or the insertion region 223. Because the assembly chamber 202 is further reduced in this region, the seal 300 is successively increasingly mechanically compressed when moving the connecting unit 100 forward. As an available location inside the assembly chamber 202 or the seal groove 123 is delimited, the seal 300 in turn begins to lengthen. This is again intended to be understood in a broad sense, wherein the seal 300 can be or is passively deformed in all spatial directions Ax, Hr, Qr, if the assembly chamber 202 and the seal groove 123 allow, by virtue of a relative movement between the connecting unit 100 and the inner wall 240 of the sealing section 204.

Figure 9:
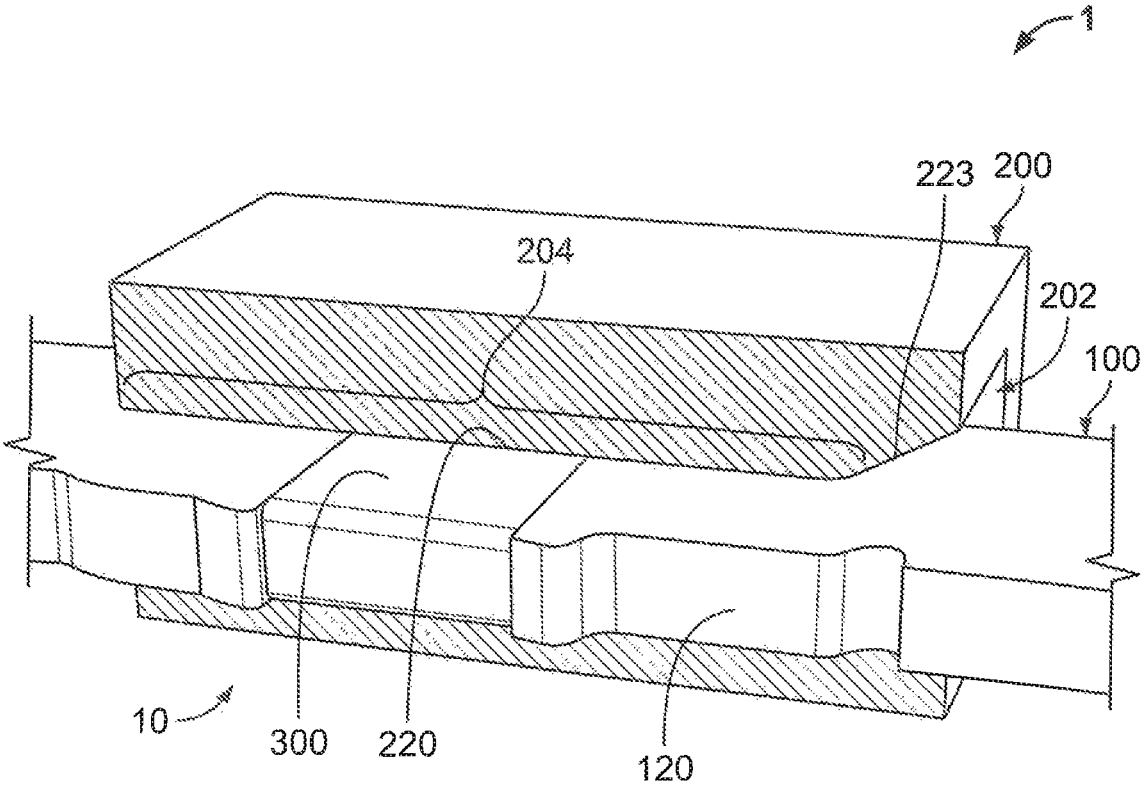
FIG. 9 is a sectional perspective view of the electrical connecting unit with the seal after insertion of the seal into the connector receptacle of FIG. 8.

This elastic and/or plastic deformation of the seal 300 takes place substantially in the axial direction Ax of the connecting unit 100 as shown in FIGS. 6 and 7. Furthermore, if initially no adhesive 300 or no seal 300 is provided at a small-area side surface of the connecting unit 100, the adhesive 300 or the seal 300 is deformed or flows into a space between a small-area outer side surface of the connecting unit 100 and the inner wall 240 of the sealing section 204 as shown in FIGS. 6 and 9. In this case, an appropriate space can be formed to be extra large such that the adhesive 300 or the seal 300 can be easily integrated therein.

As shown in FIGS. 7 and 8, a single or a plurality of seals 300 of the connecting unit 100 can substantially completely or completely surround and seal a space between the connecting unit 100 and the inner wall 240 of the sealing section 204 at the seal recess 123 or the seal groove 123. As a result, a cavity at the latching unit 122 can be closed as shown in FIG. 9.

The sealing of the electrical connector 1 as described in the embodiments of FIG. 1-9 is less expensive than known potting to produce, due to an avoidance of a complex casting method with a sealing material, and has a smaller overall construction. Further, significantly less sealing material or adhesive 300 is required for the sealing. In another embodiment, the embodiment described with reference to FIGS. 1-4 can be combined with the embodiment described with reference to FIG. 5-9, resulting in a combined cavity 245 and 123 for the seal 300 made up of the expansion 245 and the seal recess 123.

What is claimed is:

1. An electrical connecting unit for an electrical connector, comprising:

an adhesive disposed in a seal recess of the electrical connecting unit, the adhesive disposed at least partially circumferentially around the electrical connecting unit or at at least a side of the electrical connecting unit, the adhesive is elastically and/or plastically deformable and adheres to the electrical connecting unit to provide a seal for the electrical connector, the adhesive is elongated within the seal recess along an axial extent of the electrical connecting unit when deformed and rests fixedly against the electrical connecting unit.

2. The electrical connecting unit of claim 1, wherein the connecting unit has an assembly section in which the adhesive is disposed, and in a round cross-section of the assembly section the adhesive is formed as an at least partially circumferential bulb seal.

3. The electrical connecting unit of claim 1, wherein:

the adhesive forms a highest point of at least one side of the electrical connecting unit.

4. The electrical connecting unit of claim 1, wherein the connecting unit has an assembly section in which the adhesive is disposed, and in a rectangular cross-section of the assembly section the adhesive is formed as a bulb seal on at least one large-area side of the assembly section, the bulb seal extends substantially transversely to an axial extent of the connecting unit.

5. The electrical connecting unit of claim 4, wherein the adhesive has a sealing cap disposed at a longitudinal end section of the bulb seal.

6. The electrical connecting unit of claim 1, wherein, when the adhesive is deformed, the adhesive extends across an entire axial extent of the seal recess.

7. The electrical connecting unit of claim 6, wherein, when the adhesive is deformed, the adhesive remains within a vertical extent of the seal recess.

8. A sealing arrangement for an electrical connector, comprising:

a connector receptacle formed of an insulative material;

an electrical connecting unit inserted into an assembly chamber of the connector receptacle; and an adhesive installed in the assembly chamber between the electrical connecting unit and an inner wall of the assembly chamber and disposed in a seal recess of the electrical connecting unit, the adhesive disposed at least partially circumferentially around the electrical connecting unit or disposed at at least a side of the electrical connecting unit, the adhesive is elastically and/or plastically deformed between the electrical connecting unit and the inner wall of the assembly chamber, the adhesive is elongated within the seal recess along an axial extent of the electrical connecting unit when deformed and rests fixedly against the electrical connecting unit.

9. The sealing arrangement of claim 8, wherein:

the adhesive is formed as a sealant or a sealing glue;

the adhesive is extended and/or compressed in the assembly chamber; and/or the adhesive is more fixedly connected to the electrical connecting unit than to the inner wall of the assembly chamber.

10. The sealing arrangement of claim 8, wherein:

the adhesive is formed as an at least partially circumferential bulb seal at the electrical connecting unit;

the adhesive is formed at the electrical connecting unit as a bulb seal which extends substantially transversely to the axial extent of the electrical connecting unit; and/or a sealing cap is disposed at a longitudinal end section or at a pair of longitudinal end sections of the bulb seal.

11. The sealing arrangement of claim 8, wherein:

the assembly chamber has at least one expansion in which the adhesive is extended;

the assembly chamber has a centering section and a sealing section linearly adjoining the centering section, the sealing section having the at least one expansion;

the sealing section has an insertion region with a bevel, and an exterior dimension of the insertion region is greater in one direction than an outer dimension of the connecting unit with the adhesive; and/or the sealing section has a sealing region with substantially constant inner dimensions, and an inner dimension of the sealing region is smaller in one direction than an outer dimension of the connecting unit with the adhesive.

12. The sealing arrangement of claim 8, wherein:

the assembly chamber is entirely formed as a cylindrical recess or a cuboid recess with an exception of a latching unit of the assembly chamber;

in the axial direction of the electrical connecting unit, the adhesive fills substantially an entire axial extent of the seal recess in the assembly chamber; and/or the assembly chamber has an insertion region with a bevel, and an exterior dimension of the insertion region is greater in one direction than an outer dimension of the connecting unit with the adhesive.

13. The sealing arrangement of claim 8, wherein the assembly chamber extends through the connector receptacle and/or the electrical connecting unit is latched in the assembly chamber.

14. A method for producing an electrical connector, comprising:

providing an adhesive at least partially circumferentially around or at at least a side of an electrical connecting unit for the electrical connector, the adhesive disposed in a seal recess of the electrical connecting unit; and inserting the electrical connecting unit into an assembly chamber of a connector receptacle of the electrical connector, the adhesive is elastically and/or plastically deformed between the electrical connecting unit and an inner wall of the assembly chamber, the adhesive is elongated within the seal recess along an axial extent of the electrical connecting unit when deformed and rests fixedly against the electrical connecting unit.

15. The method of claim 14, further comprising, before inserting the electrical connecting unit into the assembly chamber, at least partially cross-linking and/or at least partially solidifying the adhesive.

16. The method of claim 15, further comprising forming a seal between the electrical connecting unit, an inner wall of the assembly chamber, and the adhesive after inserting the electrical connecting unit into the assembly chamber.

17. The method of claim 16, wherein the adhesive functions as a sealant or a sealing glue of the electrical connector and/or, during insertion of the electrical connecting unit into the assembly chamber, the adhesive is deformed into a sealing layer at the electrical connecting unit.

18. The method of claim 17, wherein the electrical connecting unit is formed by a stamping method, an embossing method, a crimping method, a bending method and/or a joining method, and/or during inserting the connecting unit into the assembly chamber the connecting unit is latched in the assembly chamber.

19. An electrical connector, comprising:

a connector receptacle formed of an insulative material;

an electrical connecting unit inserted into an assembly chamber of the connector receptacle; and an adhesive installed in the assembly chamber between the electrical connecting unit and an inner wall of the assembly chamber and disposed in a seal recess of the electrical connecting unit, the adhesive disposed at least partially circumferentially around the electrical connecting unit or disposed at at least a side of the electrical connecting unit, the adhesive is elastically and/or plastically deformed between the electrical connecting unit and the inner wall of the assembly chamber, the adhesive is elongated within the seal recess along an axial extent of the electrical connecting unit when deformed and rests fixedly against the electrical connecting unit.

* * * * *